US010571130B2

(12) United States Patent
Claridge Huggins

(10) Patent No.: US 10,571,130 B2
(45) **Date of Patent: *Feb. 25, 2020**

(54) FOAM MOLD TO PROVIDE INSIDE SHAPE OF FOR PIZZA OVEN WHEN COVERED IN CONCRETE

(71) Applicant: Catherine Claridge Huggins, Bellingham, WA (US)

(72) Inventor: Catherine Claridge Huggins, Bellingham, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/597,931

(22) Filed: May 17, 2017

(65) Prior Publication Data

US 2017/0245506 A1 Aug. 31, 2017

Related U.S. Application Data

(63) Continuation-in-part of application No. 14/297,591, filed on Jun. 5, 2014, now Pat. No. 10,197,287, and a continuation-in-part of application No. 14/137,050, filed on Dec. 20, 2013, now Pat. No. 9,718,220, and a continuation-in-part of application No. 13/862,069, filed on Apr. 12, 2013, now abandoned, and a continuation-in-part of application No. 29/432,630, filed on Sep. 18, 2012, now abandoned.

(60) Provisional application No. 61/739,853, filed on Dec. 20, 2012, provisional application No. 61/635,515, filed on Apr. 19, 2012.

(51) Int. Cl.
*B29C 39/26* (2006.01)
*F24B 1/20* (2006.01)

(52) U.S. Cl.
CPC ..... *F24B 1/20* (2013.01)

(58) Field of Classification Search
USPC ..... 264/36
See application file for complete search history.

*Primary Examiner* — Jacob T Minskey
(74) *Attorney, Agent, or Firm* — Paul B. Heynssens Attorney at Law, PLC

(57) ABSTRACT

A masonry oven constructed with the aid of a mold. An exemplary foam mold to provide inside shape of for pizza oven when covered in concrete is disclosed. Our mold allows DIY Homeowners the ability to make a pizza oven in their own backyard (or wherever) by simply pouring high~temp concrete into our mold.

6 Claims, 25 Drawing Sheets

Black Pizza Oven Constructed With Core Formed With Prefabricated Mold
300

Black Pizza Oven Constructed With Core Formed With Prefabricated Mold 300

Core
314

504

504

FOAM MOLD TO PROVIDE INSIDE SHAPE OF FOR PIZZA OVEN WHEN COVERED IN CONCRETE

CROSS-REFERENCE TO RELATED APPLICATIONS

This application is a continuation in part of U.S. patent application Ser. No. 13/862,069 filed Apr. 12, 2013, which claims the benefit of U.S. Provisional Patent Application No. 61/635,515 filed Apr. 19, 2012, the contents of which are hereby incorporated by reference. This application is also a continuation in part of U.S. patent application Ser. No. 14/137,050 filed Dec. 20, 2013, which claims the benefit of US provisional patent applications 61/636,515 filed Apr. 19, 2012, and 61/739,853 filed Dec. 20, 2012. This application is also a continuation in part of U.S. patent application Ser. No. 14/297,591, filed Jun. 5, 2014, which is a continuation in part of US Design Patent Application 29/432,630 filed Nov. 18, 2012.

TECHNICAL FIELD

This description relates generally to masonry construction and more specifically to construction of masonry ovens for consumer use.

BACKGROUND

A masonry oven, also known as a brick or stone oven, is an oven including a baking chamber in which a fire is lit. Though traditionally wood-fired, coal-fired, natural gas fired or even electricity fired ovens are possible. Modern masonry ovens are often associated with artisanal bread and pizza, but in the past they were used for any cooking task involving baking. These ovens are often built by a skilled mason and therefore typically expensive to the point where people usually do not have them in their homes or in an outdoor barbeque area.

FIG. 1 shows a typical oven being hand built from brick. A cement or masonry floor 100 is constructed and each course of brick 102, 104, 106, 108, 110 is laid up and allowed to set sufficiently before the next course is added. Alternatively an oven can be cast from concrete, however a mold for such a casting is often constructed on site, and is another costly and time consuming structure to build. The mason maintains the circular shape of this oven with a compass like device 112, which similar to a plumb line for vertical surfaces, allows the mason to maintain the shape of each course as a circle and each course being in reduced diameter to form a dome. Needless to say such a brick by brick process is expensive and time consuming to construct. And if not done by a skilled mason the result can be an oven that does not heat properly, and that may be less than pleasing to look at.

The direct-fired masonry oven is often called a "Roman" or "black" oven, because of its origin. It is called a black oven because the smoke from the wood used as fuel sometimes collects as soot on the roof of the oven. As previously stated masonry ovens are not easy to construct, however the ovens were in wide use throughout medieval Europe and were often built to serve entire communities, where the owners or local governments that built them might charge a fee for their use. Such ovens are still in wide use in artisanal bakeries and pizzerias. Also, in the pre-Columbian Americas, similar ovens, called by the Spanish term hornos, were often made of clay or adobe. This construction technique has been used since antiquity, and does an excellent job of baking various items. However modern technology has provided a somewhat satisfactory solution to building a custom built masonry oven.

FIG. 2 shows an table top pizza oven 200 constructed of metal and other modern materials. Such ovens are used in commercial settings, but tend to be expensive, aesthetically unappealing, and they do not store and radiate heat like a masonry oven. However such an oven may be somewhat light weight, and easy to ship and install. However, many people still prefer bread and pizza that has been cooked in a masonry oven, and may find the modern metal oven a poor substitute for the masonry oven.

People are unable to easily, and economically create a pizza oven out of cast high temperature concrete. Prefabricated ovens, often shipped in pieces, are heavy to ship and expensive. It would be advantageous for a homeowner or consumer to be able to build a cast pizza oven with a onetime use mold, with far less cost (Do-it-yourself vs. a machine made oven) than a custom built oven to carry out artisan baking in their home or yard.

SUMMARY

The following presents a simplified summary of the disclosure in order to provide a basic understanding to the reader. This summary is not an extensive overview of the disclosure and it does not identify key/critical elements of the invention or delineate the scope of the invention. Its sole purpose is to present some concepts disclosed herein in a simplified form as a prelude to the more detailed description that is presented later.

The present example provides a process for constructing a masonry pizza oven, utilizing a specially constructed mold. The mold described herein allows do-it-yourself homeowners the ability to build a pizza oven, that looks like it was constructed by a professional mason, in their own backyard (or wherever) by casting or pouring high-temp concrete into a mold as part of the fabrication process.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

Figure 1:
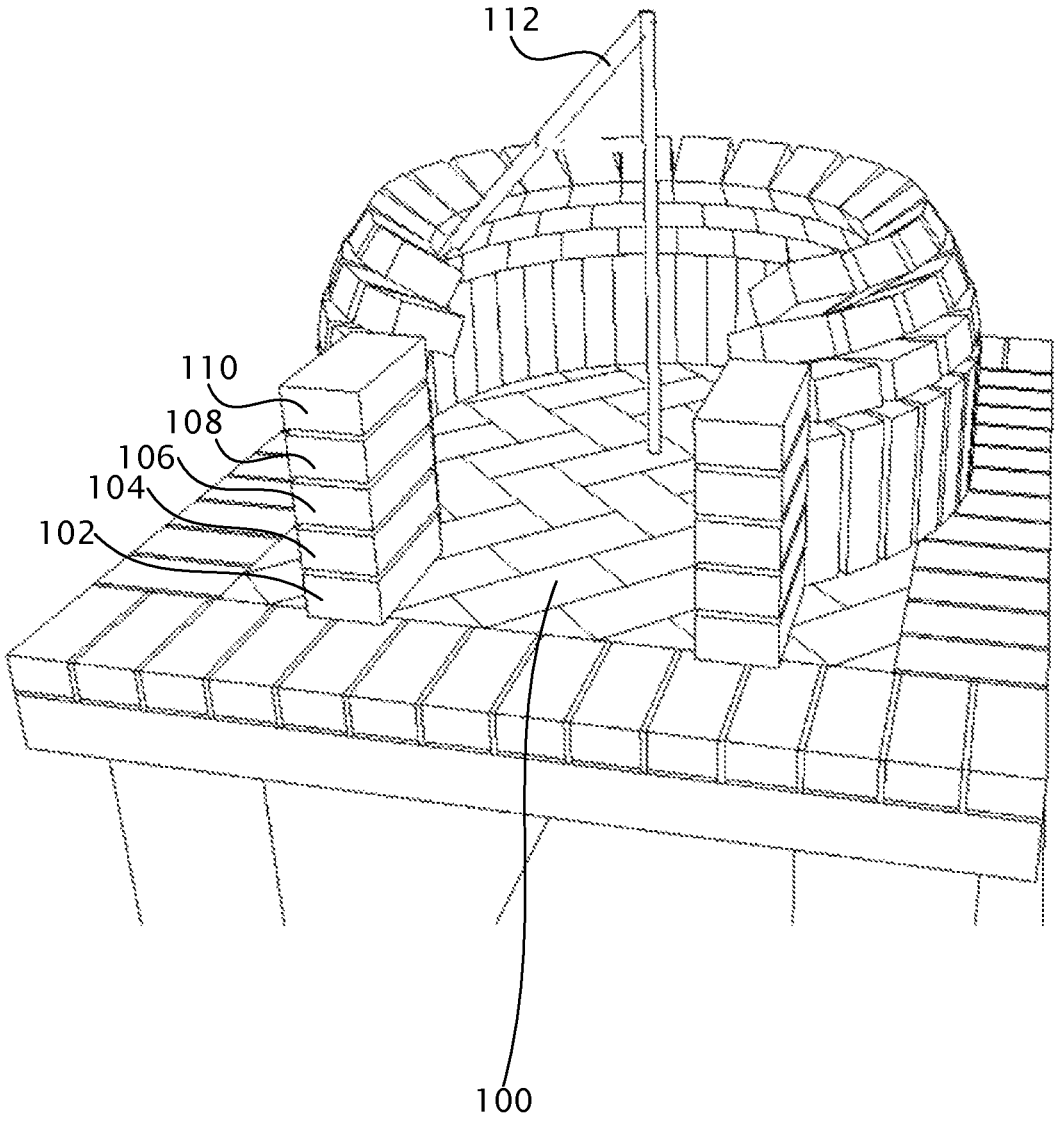
PRIOR ART FIG. 1
FIG. 1 shows an oven being built from brick.
Figure 2:
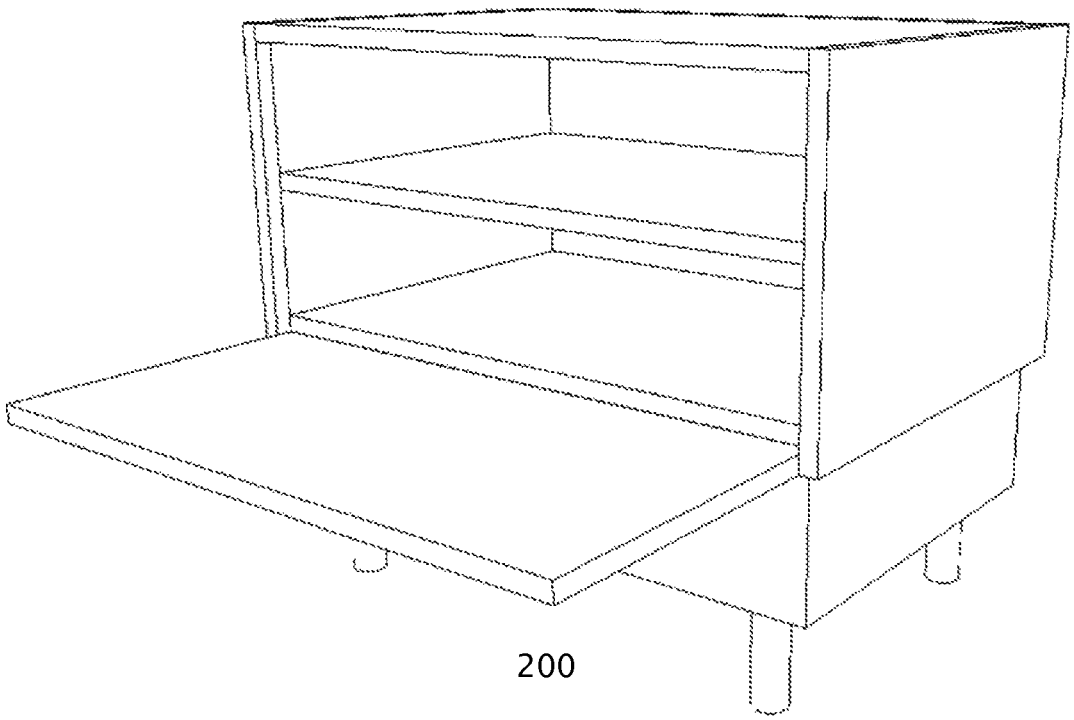
PRIOR ART FIG. 2
FIG. 2 shows an table top pizza oven constructed of metal and other modern materials.

The detailed description provided below in connection with the appended drawings is intended as a description of the present examples of a masonry (or equivalently "pizza" oven) and is not intended to represent the only forms in which the present example of a self-cast masonry oven may be constructed or utilized. The description sets forth the functions of the example and the sequence of steps for constructing and operating the example. However, the same or equivalent functions and sequences may be accomplished by different examples. Dimensions may be shown in some drawings, the dimensions shown are only exemplary and not intended to be limiting, as the oven may be scaled, up or down as desired. The proportions are also but exemplary, as other proportions of one component or element may be varied while still maintaining the overall function of the oven for artisan baking.

The problem this invention solves is the ability to have a pizza oven without the high cost, high shipping cost and massive manpower needed to enjoy a pizza oven. This invention gives anyone the ability to make a pizza oven out of a high-temperature concrete. After building the proper pizza oven base, the user simply places the invention on top of the cooking surface and pours the high-temperature concrete mix into the mold (invention). After the mold is full of concrete . . . it will harden for several days. Then the foam invention can simply be torn off and the cast of a perfect pizza oven will remain, As previously described, people are generally unable to easily create a pizza oven out of brick or cast high temperature concrete. Prefabricated ovens are heavy to ship and expensive. This system creates ovens that look and function like a hand crafted brick-by-brick built oven, but on a onetime use platform resulting in far less cost to produce an aesthetically pleasing and functional oven capable of performing artisan baking at home. The mold described herein allows do-it-yourself homeowners the ability to make a pizza oven in their own backyard (or wherever) by simply pouring high-temp concrete into a mold as part of the fabrication process described herein.

The examples below describe a cast concrete pizza oven. Although the present examples are described and illustrated herein as being implemented in a pizza oven, the system described is provided as an example and not a limitation. As those skilled in the art will appreciate, the present examples are suitable for application in a variety of different types of oven or baking systems such as for baking artisan breads and other dishes.

Wood-fired pizza ovens such as the examples described herein, use wood fuel for cooking. There are typically two types of wood-fired pizza ovens that the molded oven described herein could be applied to, "black ovens" and "white ovens". The process and mold described herein may advantageously be used in the construction of either type of oven. And in addition a variety of oven shapes may be created with various mold designs, that may be used to produce an oven by the methods described herein.

Black ovens are heated by burning wood in the same chamber and the food is cooked alongside the fire, while it is still going. Or the food is cooked in the heated chamber after the fire and coals have been swept out. A black oven is typically heated just once by burning wood inside the oven chamber. After the coals are raked out, the oven cools over a period of hours. Immediately after a firing, the oven temperature may exceed 1000 degrees Fahrenheit. The mass of the oven acts as a 'thermal reservoir, which slowly releases heat over time. The retained heat in the oven may be used to cook multiple batches of bread, or alternatively, foods requiring different temperatures can be cooked in succession as the temperature of the oven slowly drops. This practice maximizes the efficiency of the oven, by fully utilizing the thermal energy stored during the firing process.

White ovens may be heated by heat transfer from a separate combustion chamber and flue-gas path. The cooking chamber of the oven remains "white", or clean from ash. The "white oven" is a somewhat more complex design that pipes heat in from an external firebox without routing the smoke from the fire through the oven.

Hybrid oven designs may combine aspects of both internal and external-fired oven models. The mold and the method of construction described herein may be advantageously applied in the construction of black, white, and hybrid ovens.

Figure 3:
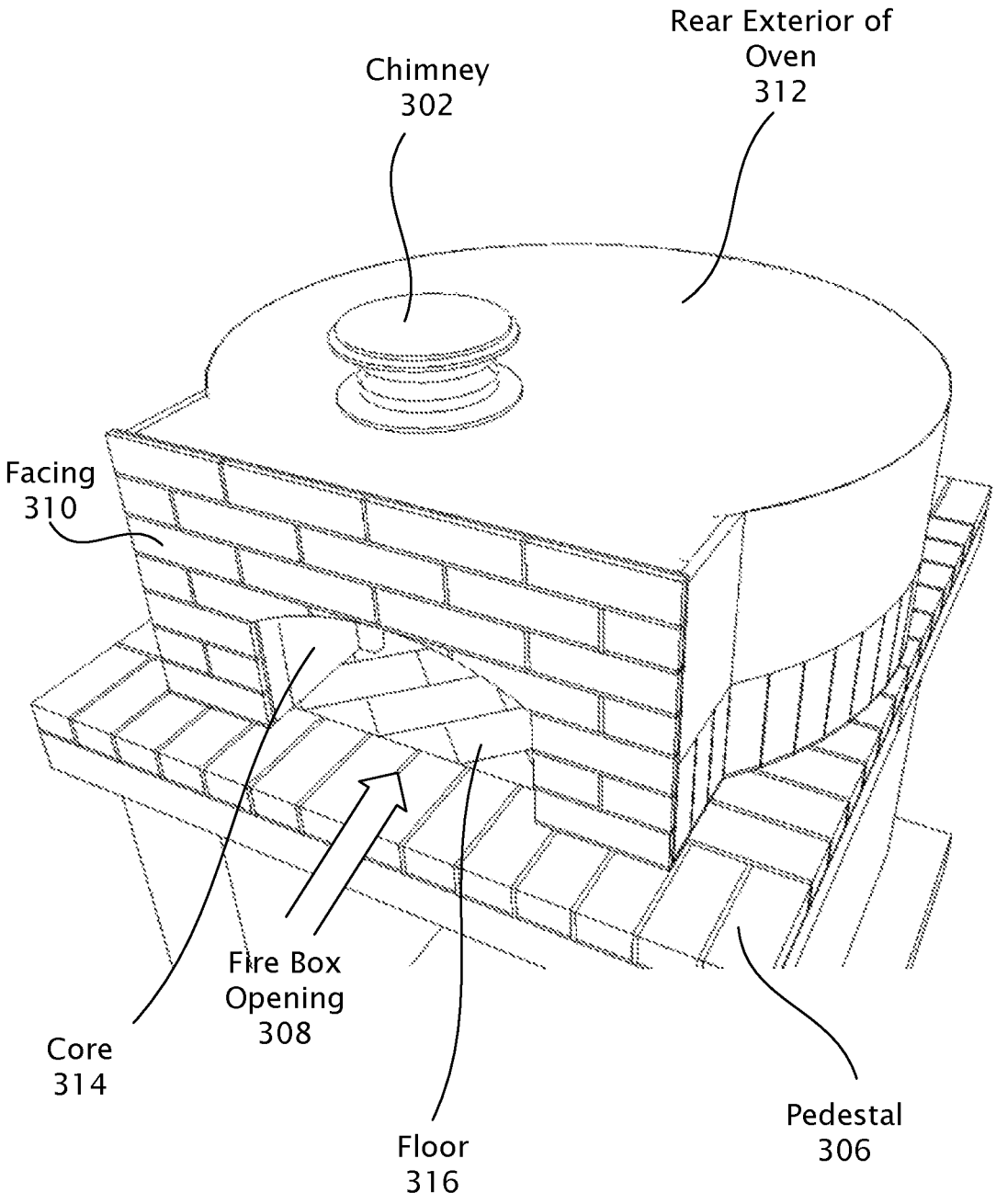
FIG. 3 is a pictorial diagram of a dome shaped wood fired pizza oven built using the mold and construction process described herein.

FIG. 3 is a pictorial diagram of a dome shaped wood fired black pizza oven 300 built using the mold and construction process described herein. The oven 300 may be built on top of a masonry (or other suitable material) pedestal 306. The core 314 is cast in place substantially on the pedestal 306, where thermal blanketing (not shown) may be applied over the core 314, and a decorative facing 310 may be applied. For additional ornamentation the rear exterior of the oven 312 may have a suitable brick veneer, stone veneer or the like applied to produce virtually any decorative appearance. The chimney 302 may be made from sheet metal or the like. Also the chimney 310 may be covered with a masonry or stone veneer as well to achieve a desired appearance. The opening 308 is where wood and food enters the oven interior where the cast core 314 may be seen. The cast core is visually exposed in the interior of the oven. Masonry ovens may have a concrete deck 316 or base inside the oven, that may be concrete fire brick or any other material desired that tends to hold and radiate heat.

The masonry oven described herein, due to its unitary cast construction advantageously traps and radiates heat from a fire, either built within the oven itself or in a firebox in the same way that a custom built unitary masonry oven does, giving cooking results on par with ovens found in shops and bakeries. In addition the mold and the construction process tends to make it easy for an untrained home owner, or do-it-yourselfer to construct a pizza oven that looks like a professional mason constructed it, at the fraction of the cost of a custom built oven.

Masonry ovens may be built with fire-resistant materials like firebrick or clay, or even directly cast from refractory cement. Those designed for bread use are generally quite heavily built to store several hours' worth of heat after completely burning a load of wood, while those designed for pizza or other live-fire cooking techniques can have thinner construction. The molds described herein may similarly be provided in thick and thin walled versions if desired.

Figure 4:
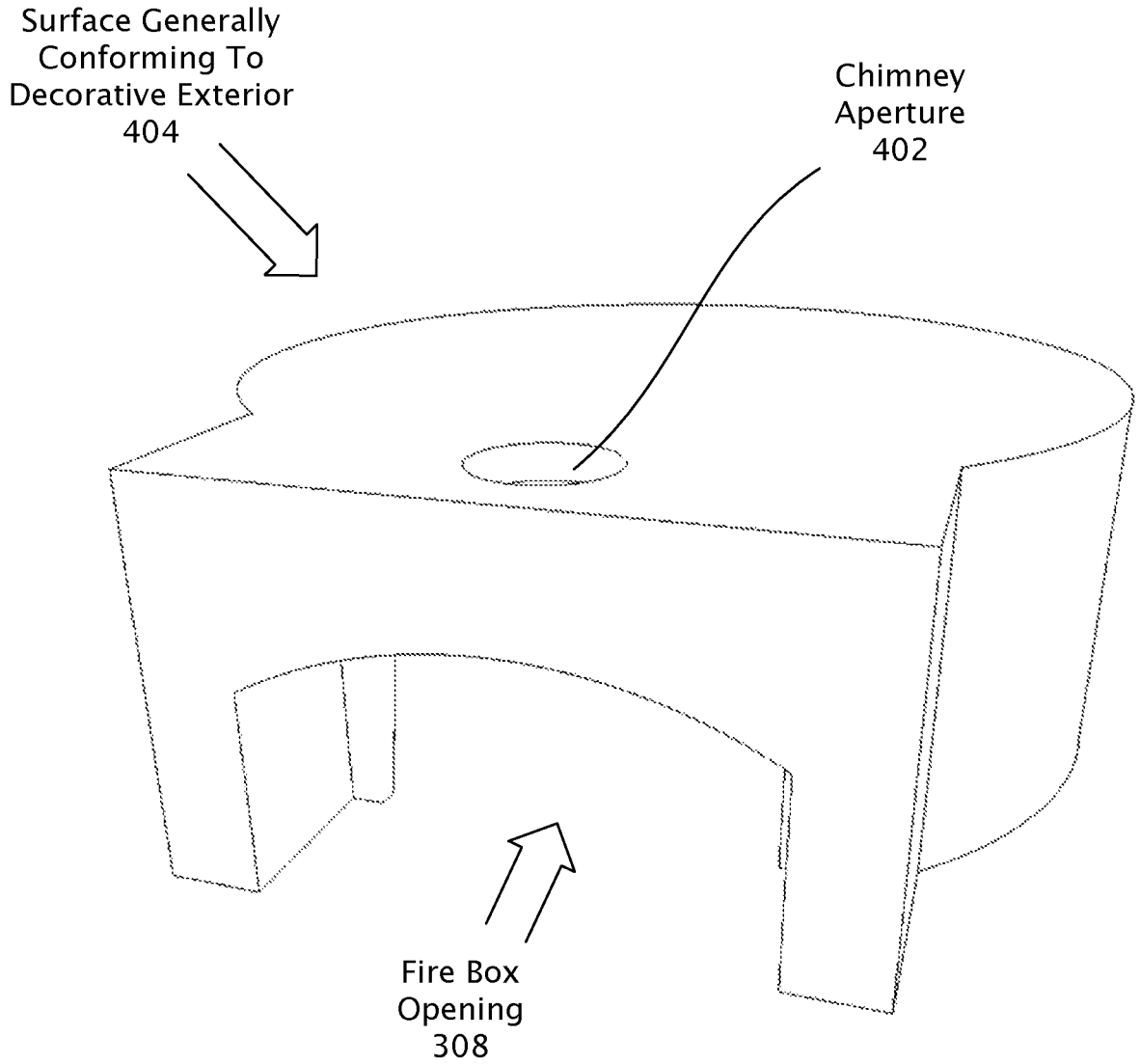
FIG. 4 is a pictorial diagram of the oven casting produced from the mold described herein.

FIG. 4 is a pictorial diagram of the exterior of the oven casting or oven core 308 produced from the mold described herein. The casting material is typically to produce the core 308 is typically refractory (high temperature resistant) cement (or its equivalent) with reinforcing material added to prevent cracking.

Generally, a pizza oven is roughly dome-shaped on the interior (and sometimes on the exterior as well), with the ceiling of the oven constructed as an arch over the baking surface. The exterior may take a variety of shapes 404, according to the design of the mold. The exterior allows any decorative shape to be provided as a support base for decorative masonry or stone work. Here the exterior is generally a right cylinder intersecting with a right prism, generally appearing to have a keyhole shape when viewed from the top. A chimney aperture 402 is provided in the top of the casting and extends into the interior void formed by the mold. The fire box opening is generally rectangular with an arched top. The opening extends into the interior of the oven. The front entrance 308 may be approximately 63% the height of the top of the oven ceiling. If the entrance is too high and heat escapes and is lost, if too low and the oven does not heat completely. Accordingly a molded oven core 308 allows the opening 308 dimensions to be set in the desired proportions, producing an oven that heats efficiently. A chimney aperture 402 is provided in a set place to help with draft, and to provide easy installation of the chimney during construction. The unitary molded construction provides a solid oven very similar to a custom built solid brick oven.

Such a large unitary core 314 would be difficult and expensive to ship, and if built on site a mason would most likely be required to achieve the result shown-possibly by utilizing an on-site custom built mold from wood or the like. Accordingly, most people are unable to easily create a pizza oven out of cast high temperature concrete. The invention herein solves this problem.

Figure 5:
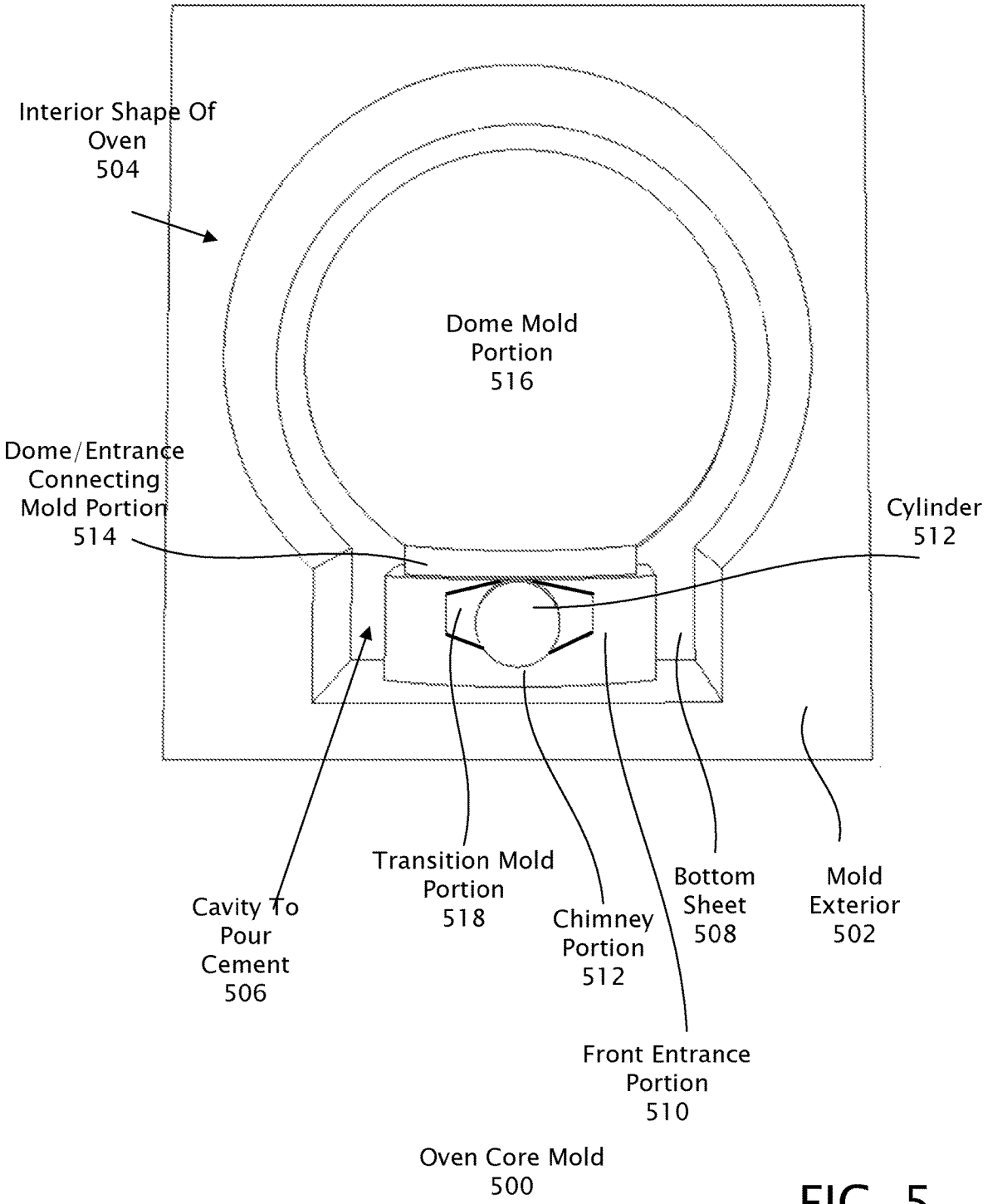
FIG. 5 shows a foam oven mold from the top side in which cement would be poured.

FIG. 5 shows a foam oven mold 500 from the top side in which cement will be poured. The foam mold may be constructed from preferably closed cell foam. However open cell foam provided with a suitable coating could be used. Foam of high or low density made by any suitable existing foam molding process is suitable. Alternatively the mold may be assembled from individual pieces of foam. The mold 500 includes a bottom sheet 508 that serves to couple a mold exterior 502 to the oven interior shape or form 504 and keeps the interior mold of the oven interior from shifting during the casting process. The shape 504 defines the shape of the oven cavity. The mold exterior 502 defines the exterior shape of the mold. The foam oven mold 500 includes foam walls 502 to keep the high temperature concrete in place while it cures and hardens. The mold 500 provides a cavity 506 in which refractory cement is poured. The dimensions shown are exemplary only and not limiting.

Interior form 504 includes a domed portion coupled to the bottom spacer sheet 508. The domed portion has generally vertical sides with a rounded, or domed top capping the cylinder formed.

The interior form further includes a front entrance form portion 510 that is coupled at a bottom side to the bottom sheet 508 and at a side to the mold exterior 502. Additionally disposed between the dome portion 516 of the mold and the front entrance portion 510 is a dome/entrance connecting portion 514 that typically reduces the opening into the interior of the oven (as defined by the dome portion 515 to which it is coupled).

The front entrance portion further includes a chimney portion 512 that extends vertically upward so that it is flush with a top surface of the mold exterior 502 (as can be seen in FIG. 4). The chimney portion is generally cylindrical, and includes a transition portion 518 to transition the rectangular chimney opening at the front entrance portion, to the cylindrical chimney.

The foam mold 500, when covered with a heat resistant concrete mix, will create the near perfect inside shape 504 for a pizza oven once the concrete has hardened and the foam is torn out. The example described differs from what currently exists. This invention creates a mold that homeowners can fill the mold with concrete to create their own oven on site. The mold and its method of oven constructing it utilizing it replace the high cost of prefabricated pizza oven, the cost of shipping such ovens and the amount of manpower it requires to move the ovens. The examples described herein allow quality ovens to be built individually and on site without requiring a skilled craftsman or mason. The mold and construction system also are very cost effective when compared to mason built ovens. The exemplary mold allows do-it-yourself homeowners the ability to make a pizza oven in their own backyard (or wherever) by a simplified on site construction the includes pouring high-temp concrete into the exemplary mold and following a process to efficiently install the oven core that has been cast.

The following FIGS. 6-21 illustrate the process of creating the oven core (304 of FIG. 4), and using it to create a finished pizza oven. In summary the examples described gives anyone the ability to make a pizza oven out of a high-temperature concrete. After building the proper pizza oven base, the user places the specially designed lightweight mold on top of the cooking surface and pours the high-temperature concrete mix into the mold. After the mold is full of concrete it will harden for several days. Then the foam mold may be torn away and the cast of a perfect pizza oven will remain.

Figure 6:
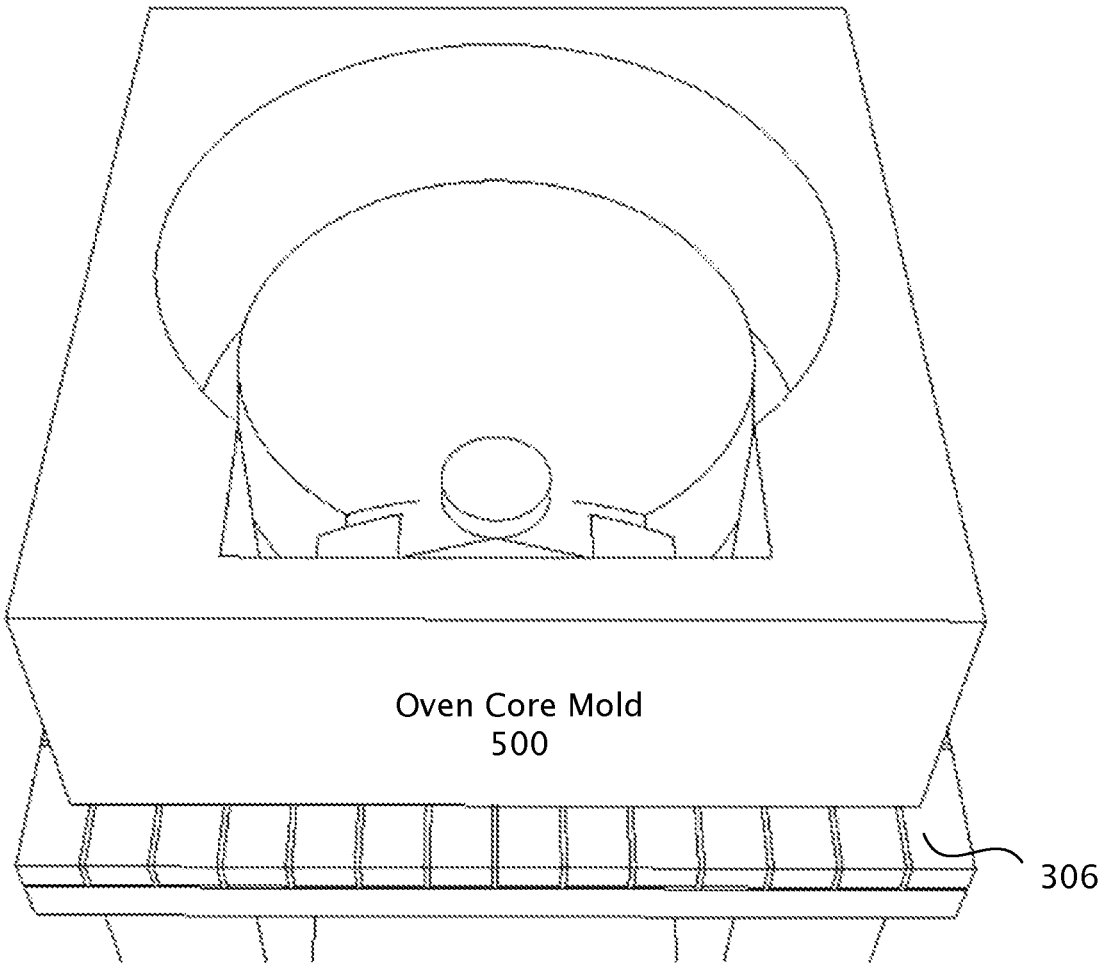
FIG. 6 shows a foam oven mold placed on a pedestal, and ready to receive newly mixed cement.

FIG. 6 shows a foam oven mold 500 disposed on a pedestal, or base 306, and ready to receive newly mixed cement. The user may buy the oven mold and easily have it shipped to the job site, as the foam is lightweight and easy to transport. Other than providing a base, no special set up, fixtures, jigs, custom molds, specialized masonry tools or the like are needed to construct the oven. The light weight mold is easily positioned on the pedestal.

The pedestal may be constructed by any suitable method, as long as a suitable surface for the floor of the oven is provided. The floor (not shown) may be of cement, brick, a combination of brick and cement, or equivalent materials that function to retain and distribute heat. The pedestal may typically be easily constructed by a homeowner, as it typically utilizes vertical, and horizontal surfaces that are easier to construct, than the curved surfaces of the oven core. Alternatively the oven may be disposed on a ground level base, or a counter that may be part of an outdoor kitchen arrangement.

Figure 7:
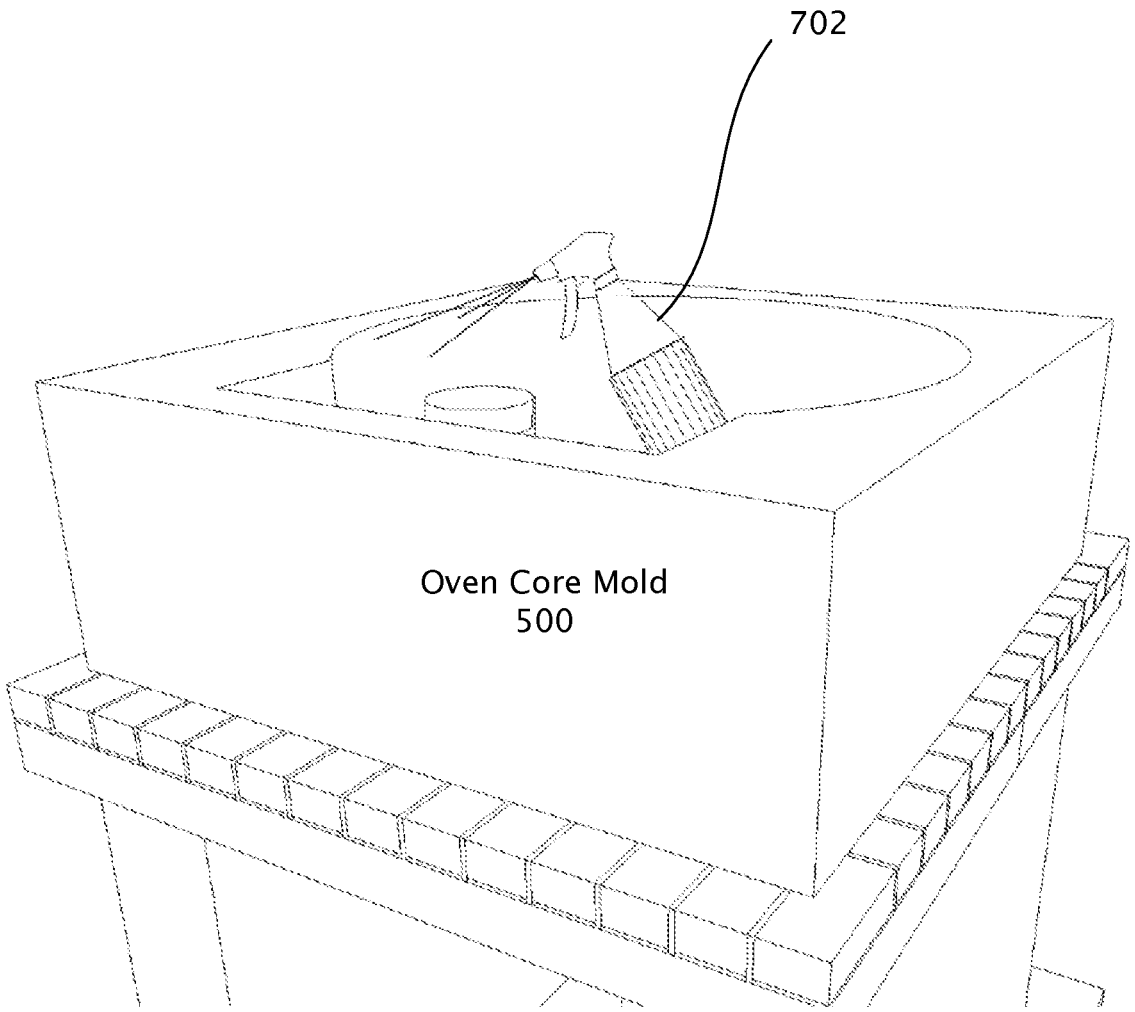
FIG. 7 shows a foam oven mold being readied to receive newly mixed cement.

FIG. 7 shows a foam oven mold being readied to receive newly mixed cement. This is optional in the construction process. Typically water may be sprayed 702 on the mold interior prior to adding the cement. However, in alternative examples the spray can be omitted, or optionally the mold may be pre coated with a material to help cement to conform to the mold, aid in release of the mold after hardening, or the like.

Figure 8:
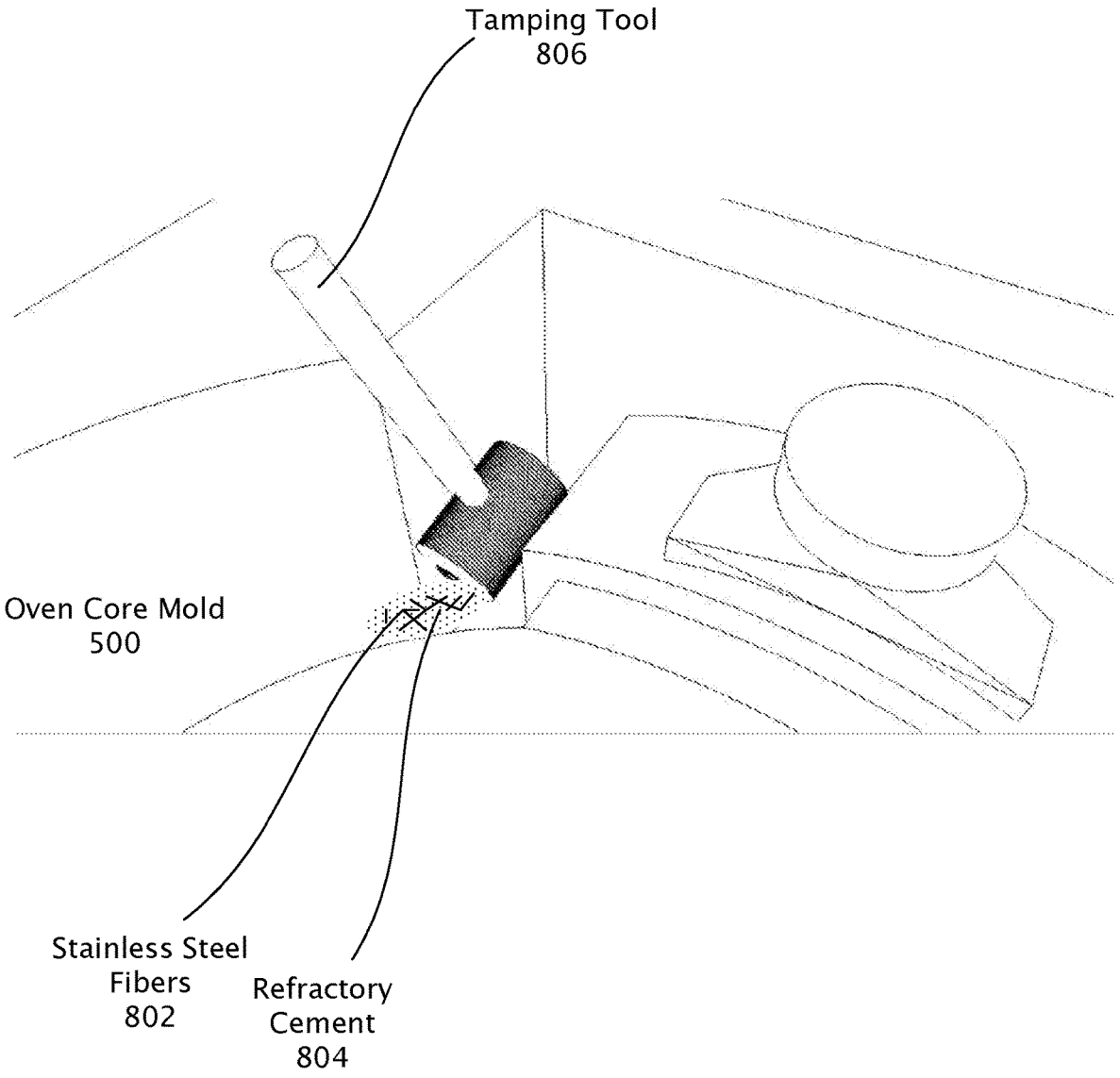
FIG. 8 shows the cement being compacted into the oven mold.

FIG. 8 shows the cement 804 being compacted into the oven mold 500. refractory cement, or its equivalent may include stainless steel fibers 802 (or their equivalent) mixed into the refractory cement. The fibers 802 tend to strengthen or reinforce the cement 804 and may prevent cracks or fissures forming. A tamping tool 806 such as a mallet or the like may be used to distribute the cement and fiber mixture into crevices and corners.

Figure 9:
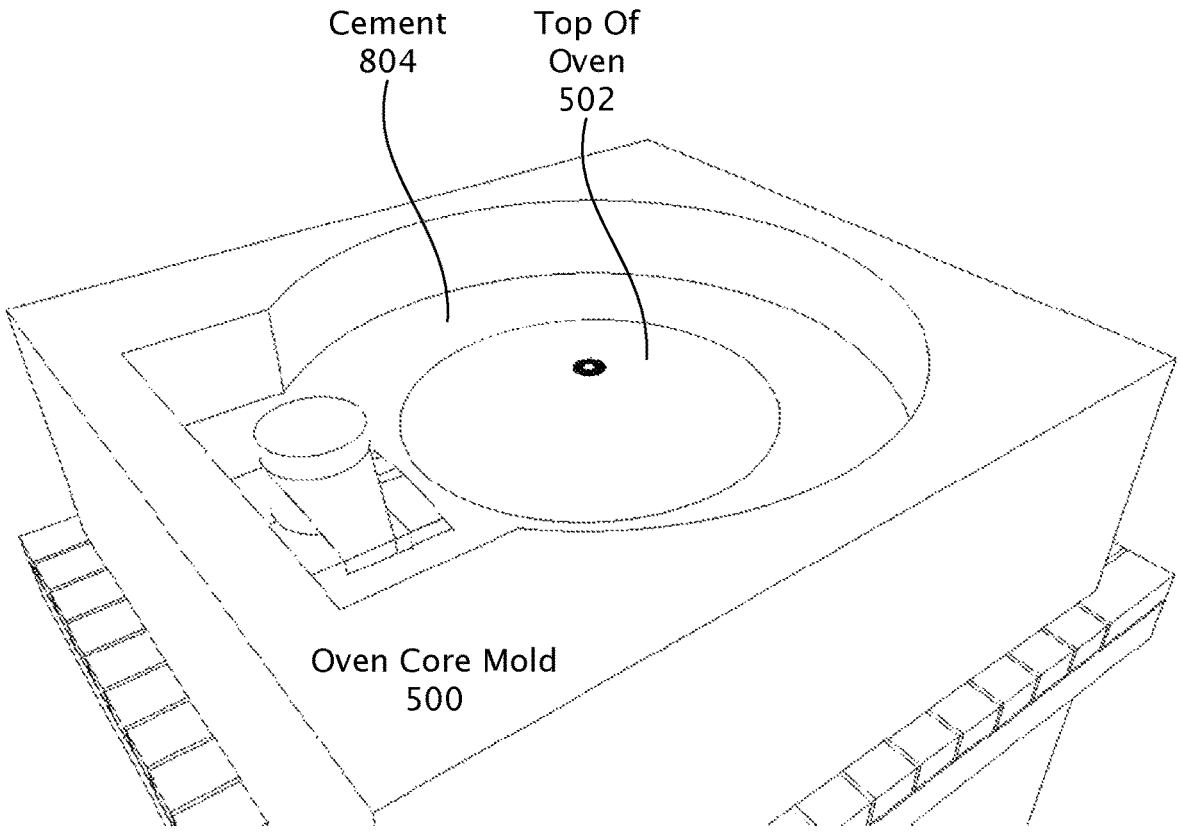
FIG. 9 shows a foam oven mold partially filled with cement.

FIG. 9 shows a foam oven mold partially filled with cement. Once the mold 500 is nearly filled with cement, the last six to seven inches towards the top should be packed especially firmly to remove air pockets. The top part of the oven chamber 502 (shown by the portion of the mold protruding from the cement 804) becomes appreciably hotter than the lower portion during use and is thus more prone to form hairline cracks, which tend to be minimized by tight packing of the cement. The solid foam form for the oven chamber advantageously provides support without collapsing during the packing process.

Figure 10:
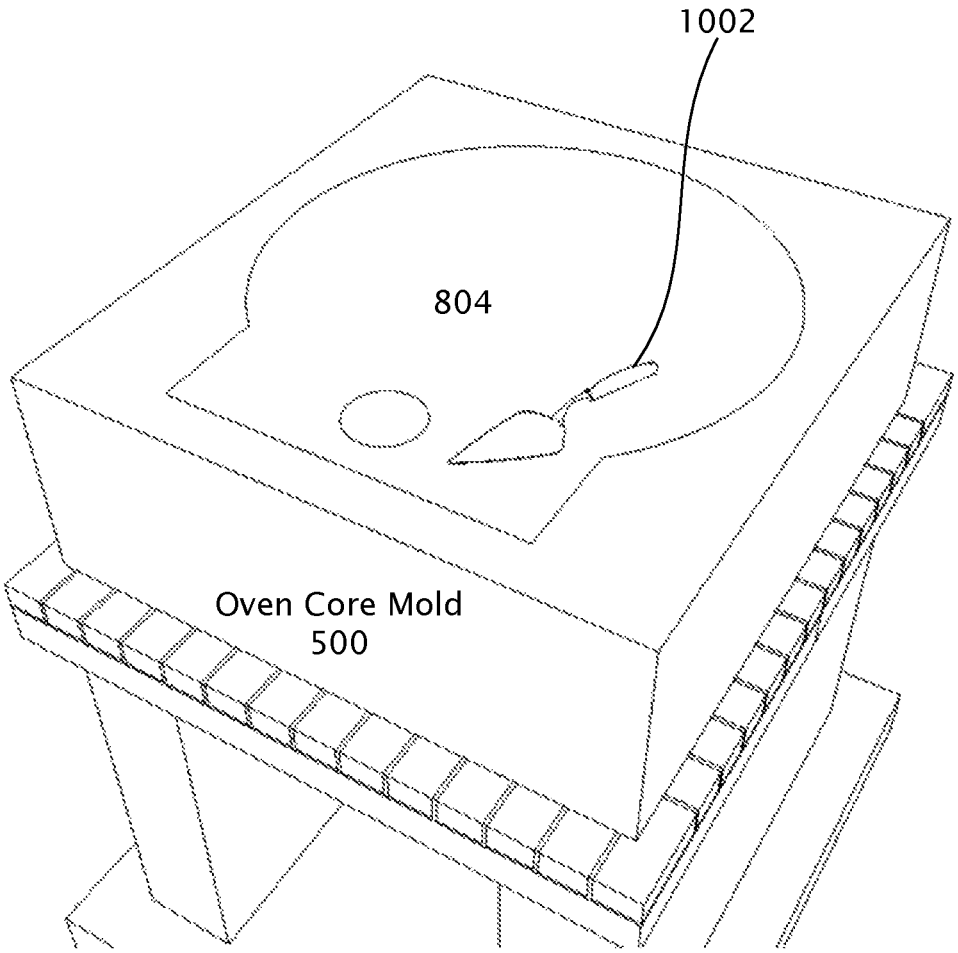
FIG. 10 shows a foam oven mold filled with cement.

FIG. 10 shows a foam oven mold 500 filled with cement 804. The cement is troweled off 1002, or otherwise leveled with the top of the mold, with the exhaust outlet, or chimney aperture 402 mold portion kept clear. The filled mold may be covered (not shown) and allowed to harden for an exemplary seven days, or equivalent.

Figure 11:
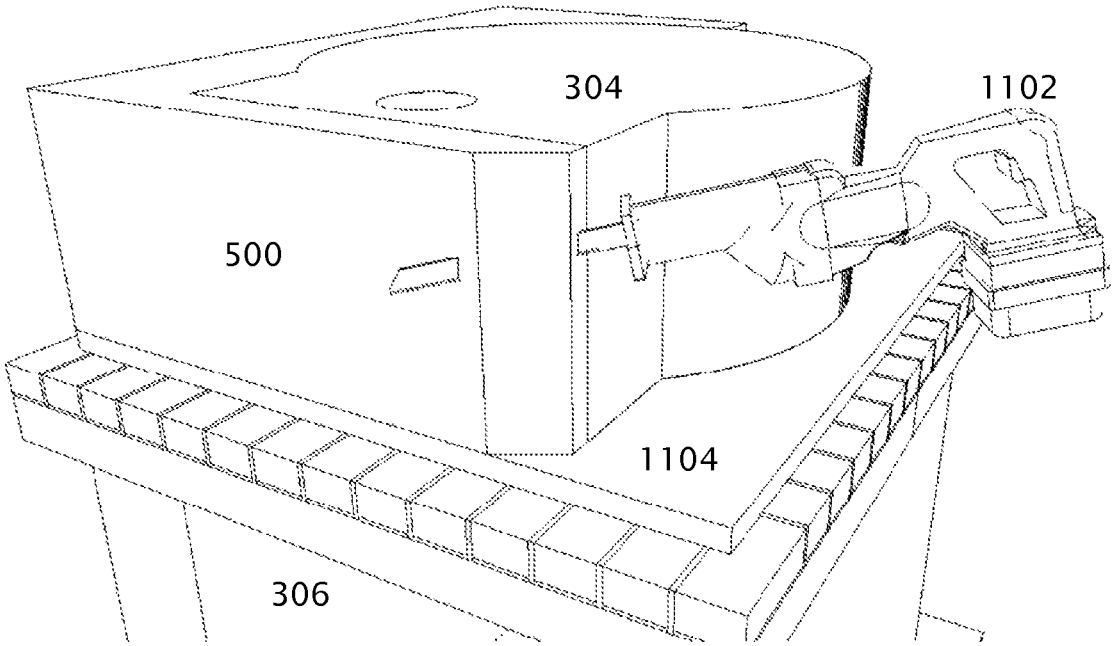
FIG. 11 shows a foam oven mold being removed from the cured oven core.

FIG. 11 shows a foam oven mold 500 being removed from the cured oven core 308. Removal may be performed with a saw 1102 or equivalent method. A portion of the foam mold 1104 remains between the core 308 and the pedestal 306. Most of the mold pieces will easily break away from the core. The mold material in the oven cavity is also removed leaving a unitary oven core, that would otherwise have had to have been laboriously constructed by a mason to achieve equivalent results.

Figure 12:
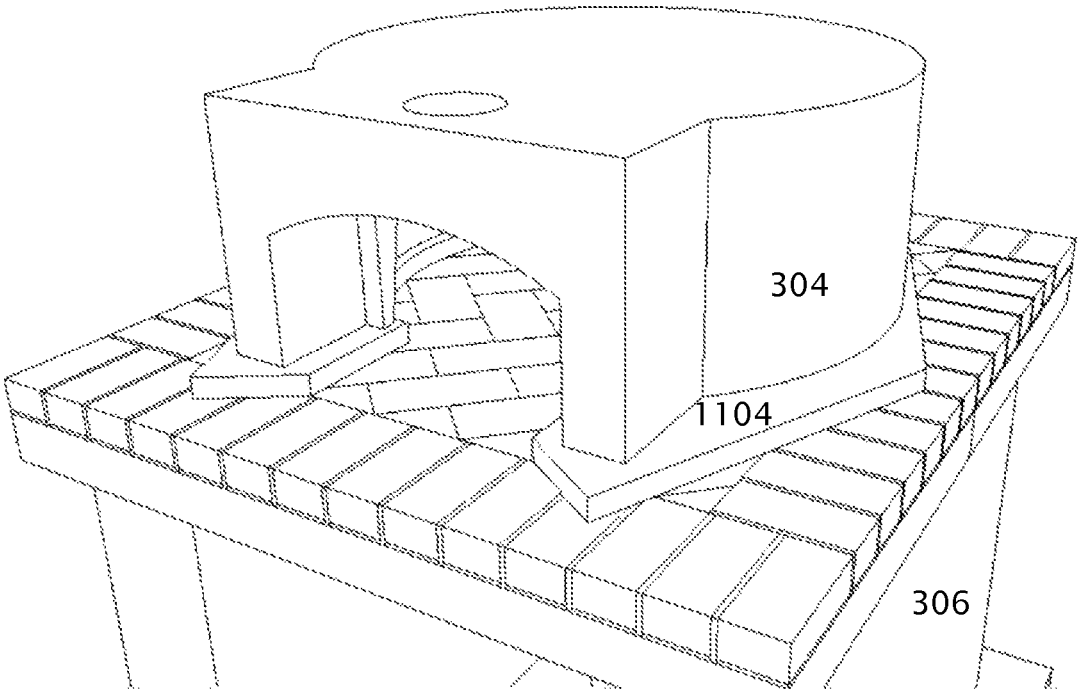
FIG. 12 shows a foam oven mold removed except for the portion between the cast core and the oven pedestal.

FIG. 12 shows a foam oven mold removed except for the mold portion 1104 between the cast core 308 and the oven pedestal 306. Here the majority of the foam has been removed.

Figure 13:
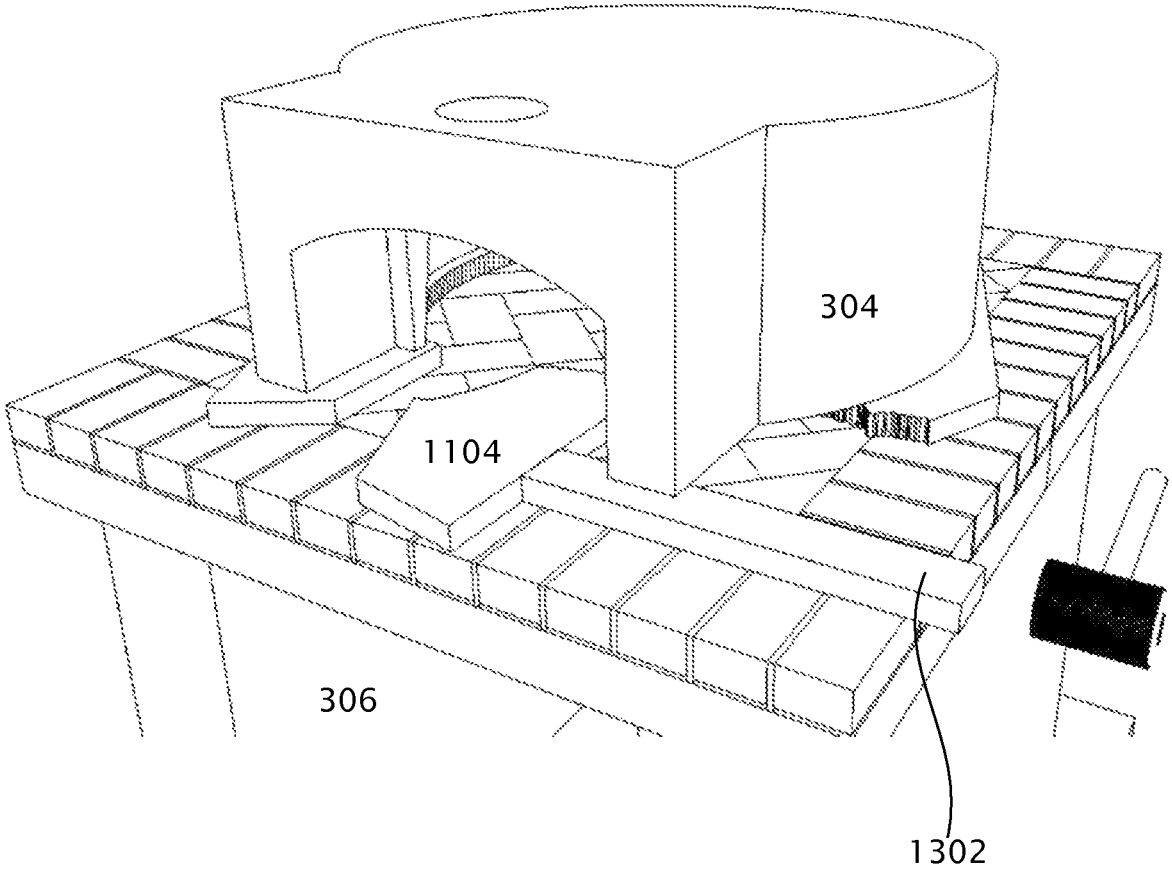
FIG. 13 shows of the foam oven mold portion between the cast core and the oven pedestal.

FIG. 13 shows of the foam oven mold portion between the cast core and the oven pedestal 1104 being removed. A wooden stake or shim 1302 may be used to knock out the remaining foam 1104. A plurality of stakes may be used. The stakes are left in place so that the oven is not yet resting on the pedestal 306.

Figure 14:
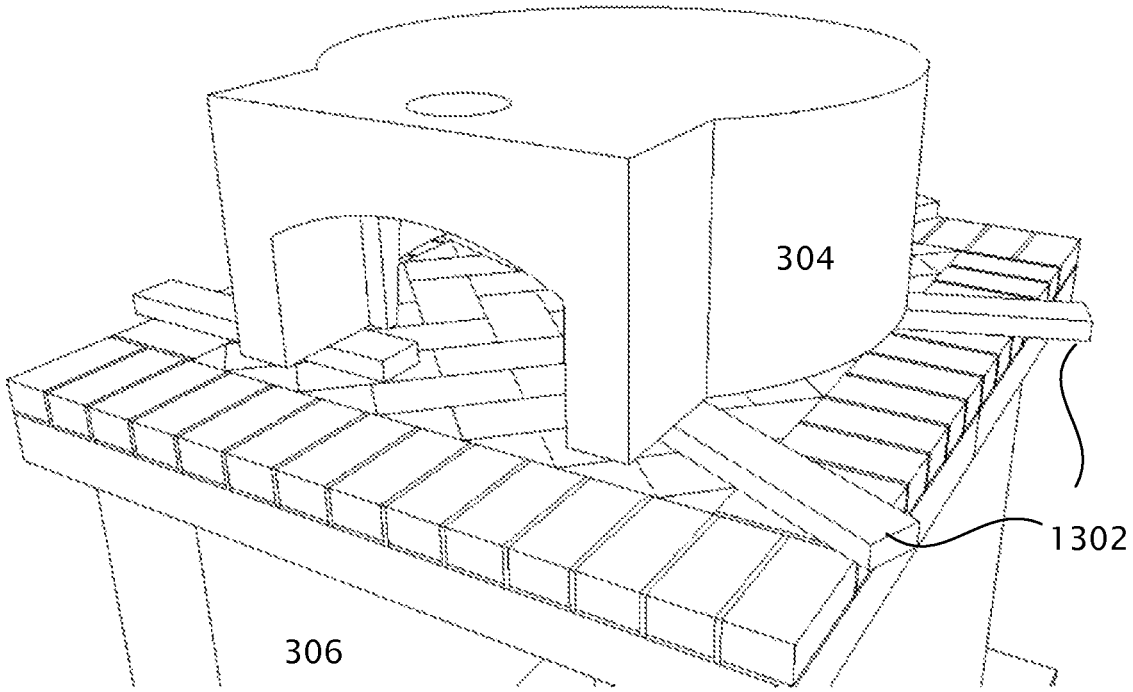
FIG. 14 shows of the oven core placed for final positioning on the oven pedestal.

FIG. 14 shows of the oven core placed for final positioning on the oven pedestal. The stakes 1302 suspend the core 308 above the pedestal 306.

Figure 15:
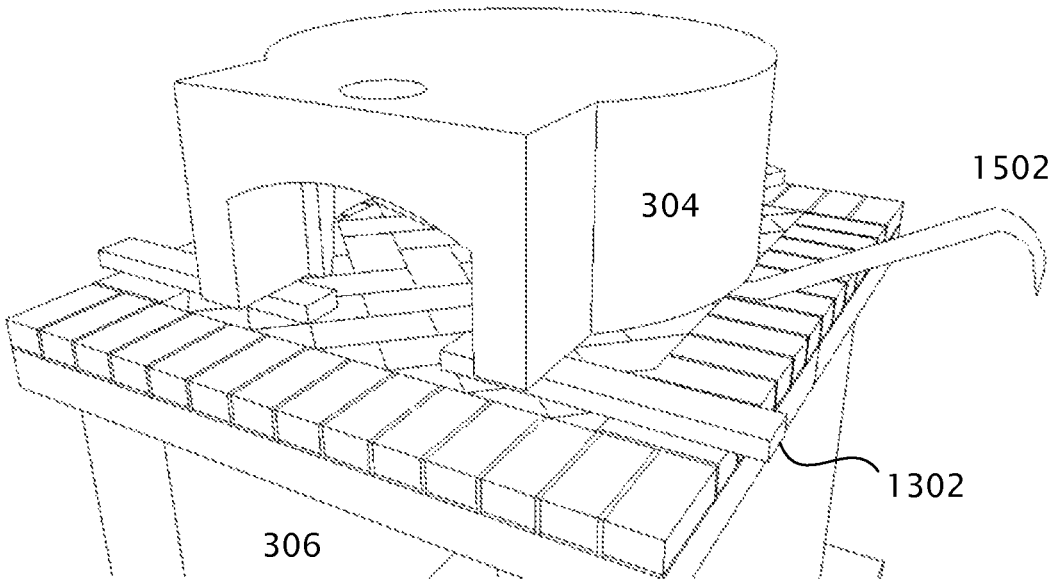
FIG. 15 shows removal of the shims between the core and base.

FIG. 15 shows removal of the shims between the core and base. A lever 1502, or equivalent lifting methods may be used to remove any excess stakes 1302 so that the core has an exemplary three points of contact with the base 306 through the remaining stakes 1302.

Figure 16:
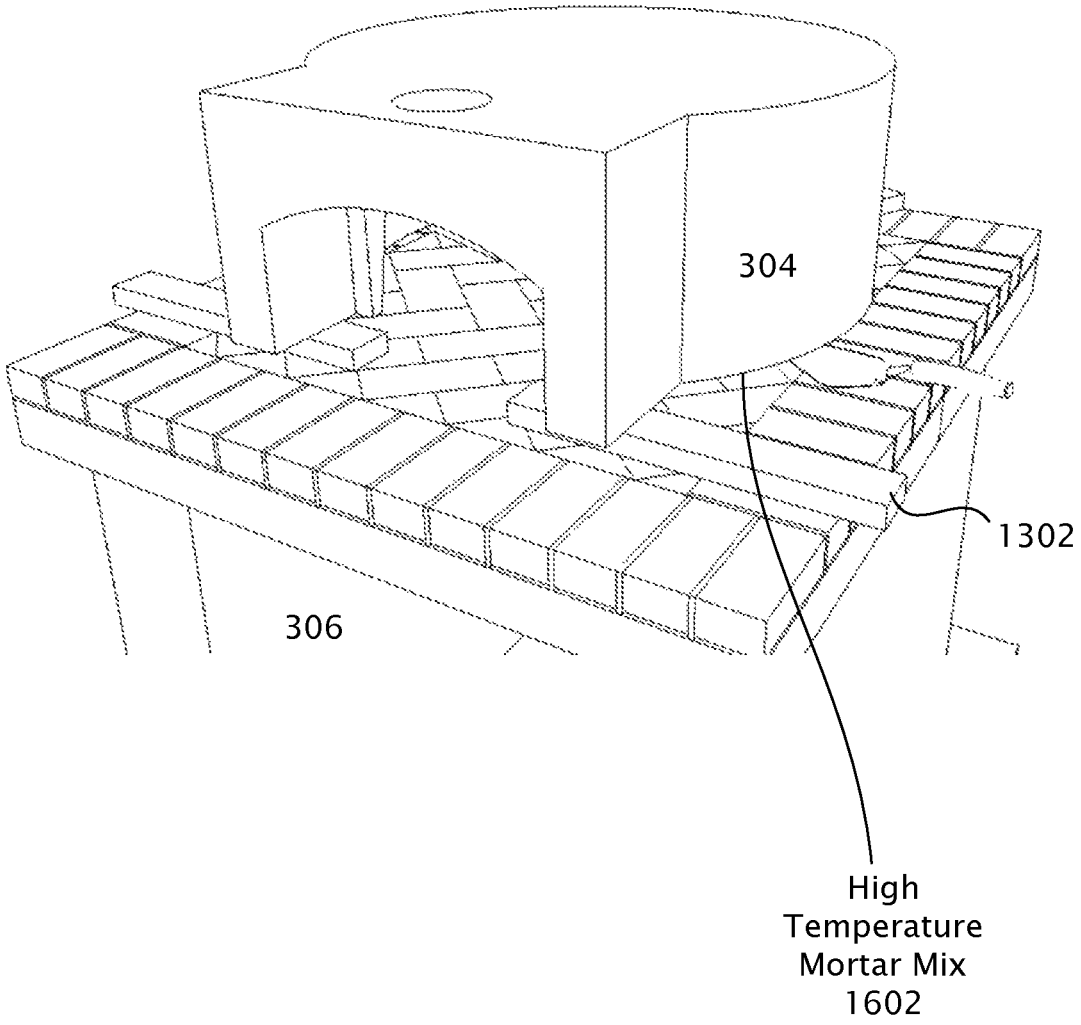
FIG. 16 shows application of sealant between the core and base.

FIG. 16 shows application of sealant between the core and base. With the core 308 elevated, high temperature mortar mix 1602 is disposed between the base 306 and core 308. The final remaining stakes may be removed as previously described and the oven core 308 finally set in place on the pedestal 306. The mortar mix seals the oven from drafts, and heat loss. Alternatively, the oven mold may include lift points so that a hoist or other device may be used to position the core, but that is not necessary as the small movement needed to finally position the core may easily be accomplished as previously described since the core has been created very close to where it will finally rest.

Figure 17:
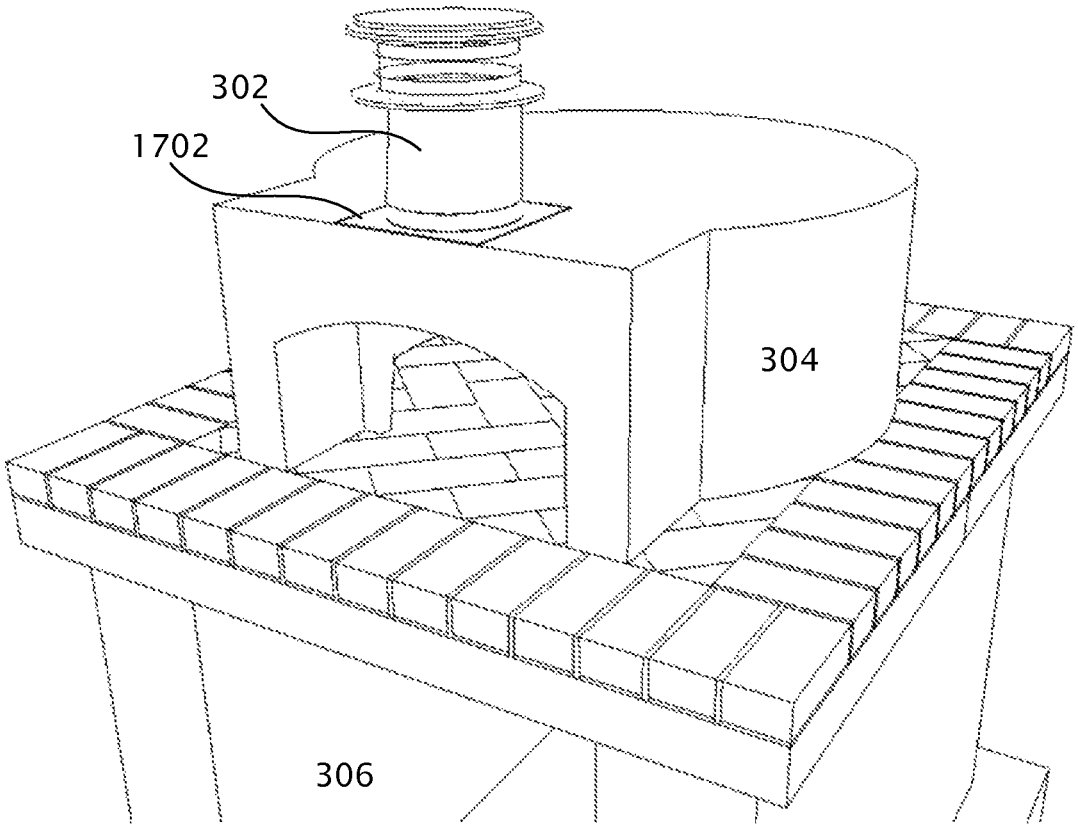
FIG. 17 shows instillation of the chimney.

FIG. 17 shows instillation of the chimney 302. A conventional anchor plate 1702 may be secured to the core 308 in a conventional manner with conventional heat resistant adhesive, and the chimney 302 assembled to the oven core 308.

Figure 18:
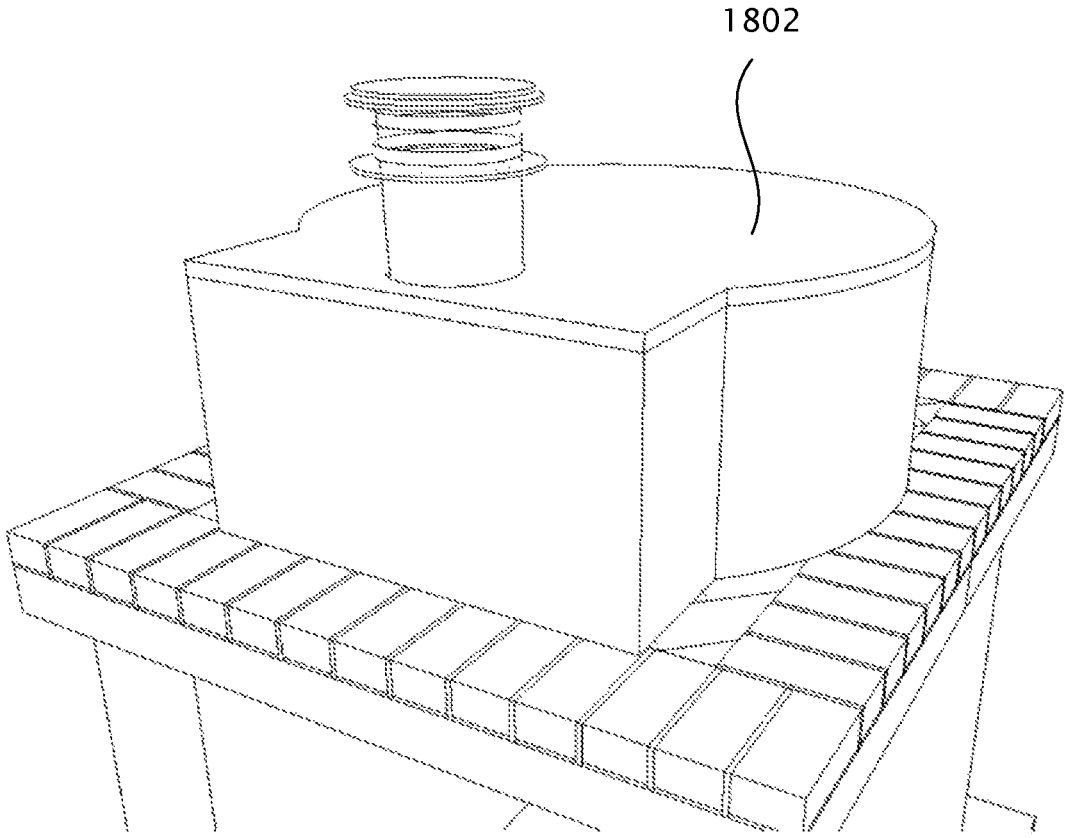
FIG. 18 shows instillation of an insulation blanket over the oven core.

FIG. 18 shows instillation of an insulation blanket 1802 over the oven core. The insulating blanket aids in heat retention, and keeps the exterior of the oven cooler. Conventional one inch (or equivalent) fiberglass batting without a paper backing may be utilized, in one layer to cover the oven. An additional exemplary two additional layers may be disposed to cover the oven-except for the front, where the opening in the core is located.

Figure 19:
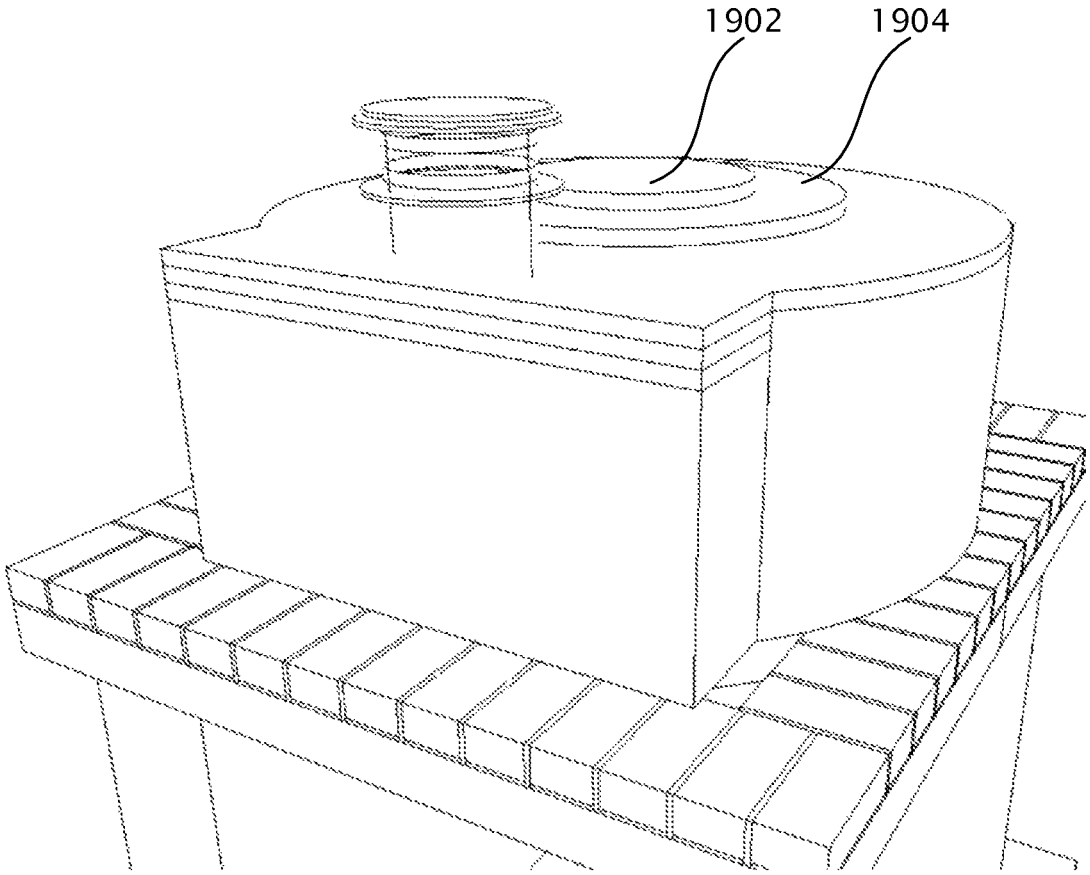
FIG. 19 shows instillation of an insulation blanket spacers.

FIG. 19 shows instillation of an insulation blanket spacers 1902, 1904. Additional spacers may be added to provide an exemplary rounded appearance to the oven. Alternatively spacers may be used to produce other decorative shapes, as desired by the builder.

Figure 20:
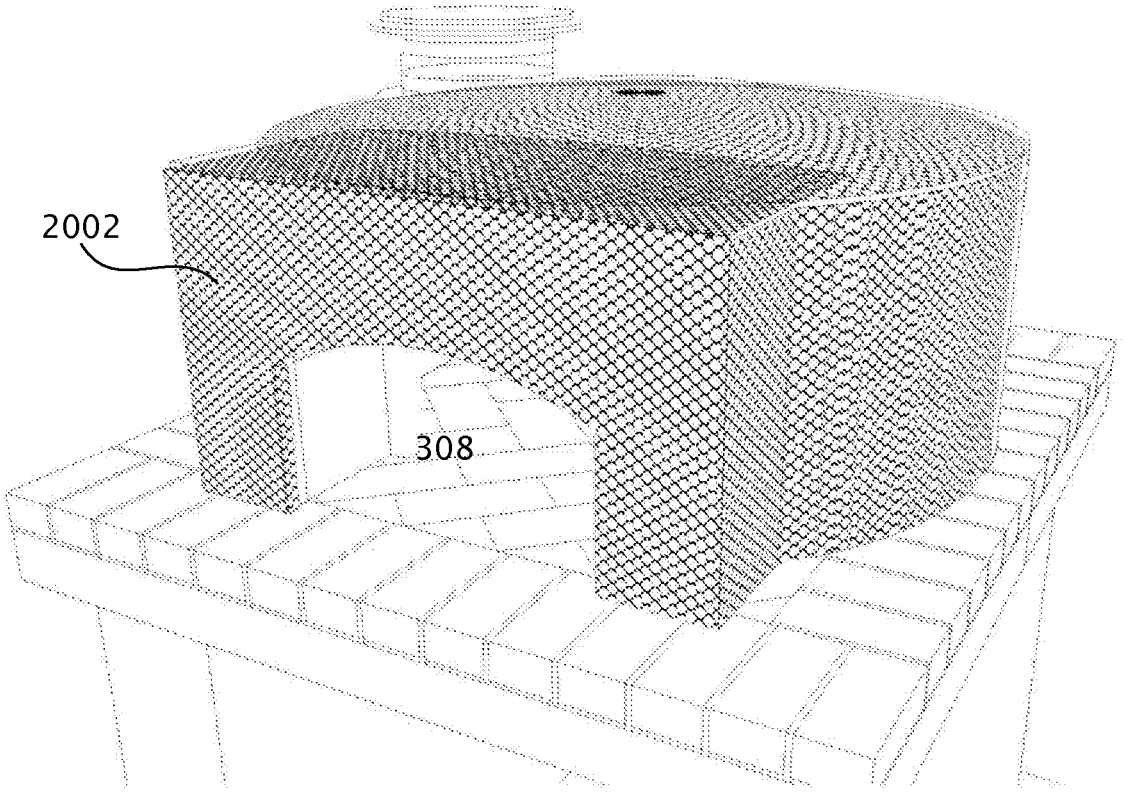
FIG. 20 shows instillation of wire netting over the oven core prior to the application of a masonry covering.

FIG. 20 shows instillation of wire netting 2002 over the oven core prior to the application of a masonry covering. This keeps the insulation in place and provides a support structure for a final masonry coating. The blanket and chicken wire may be removed from the oven core opening 308 at this time.

Figure 21:
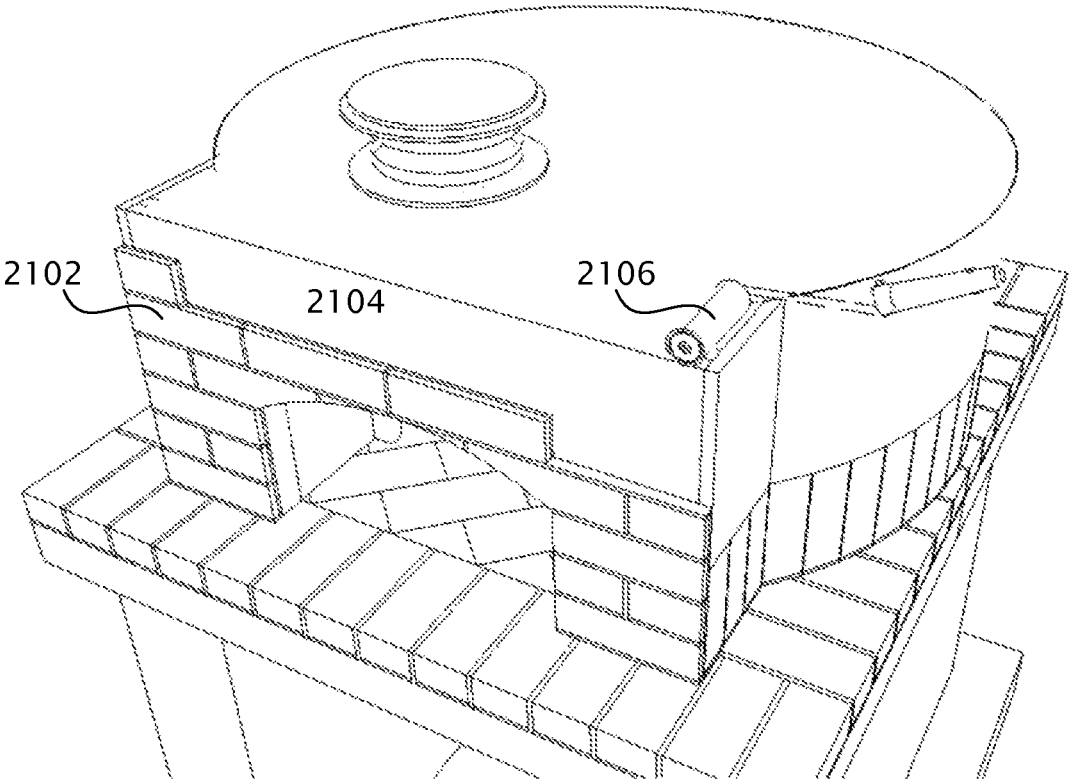
FIG. 21 shows final finishing of the oven.

FIG. 21 shows final finishing of the oven. A variety of finishes such as stucco 2104, rock, brick 2102, tile or the like may be applied to achieve any desired decorative effect. The exterior may also be painted or sealed 2106 if desired. Additional curing for an exemplary 7 days may be provided before firing the oven for cooking.

Figure 22:
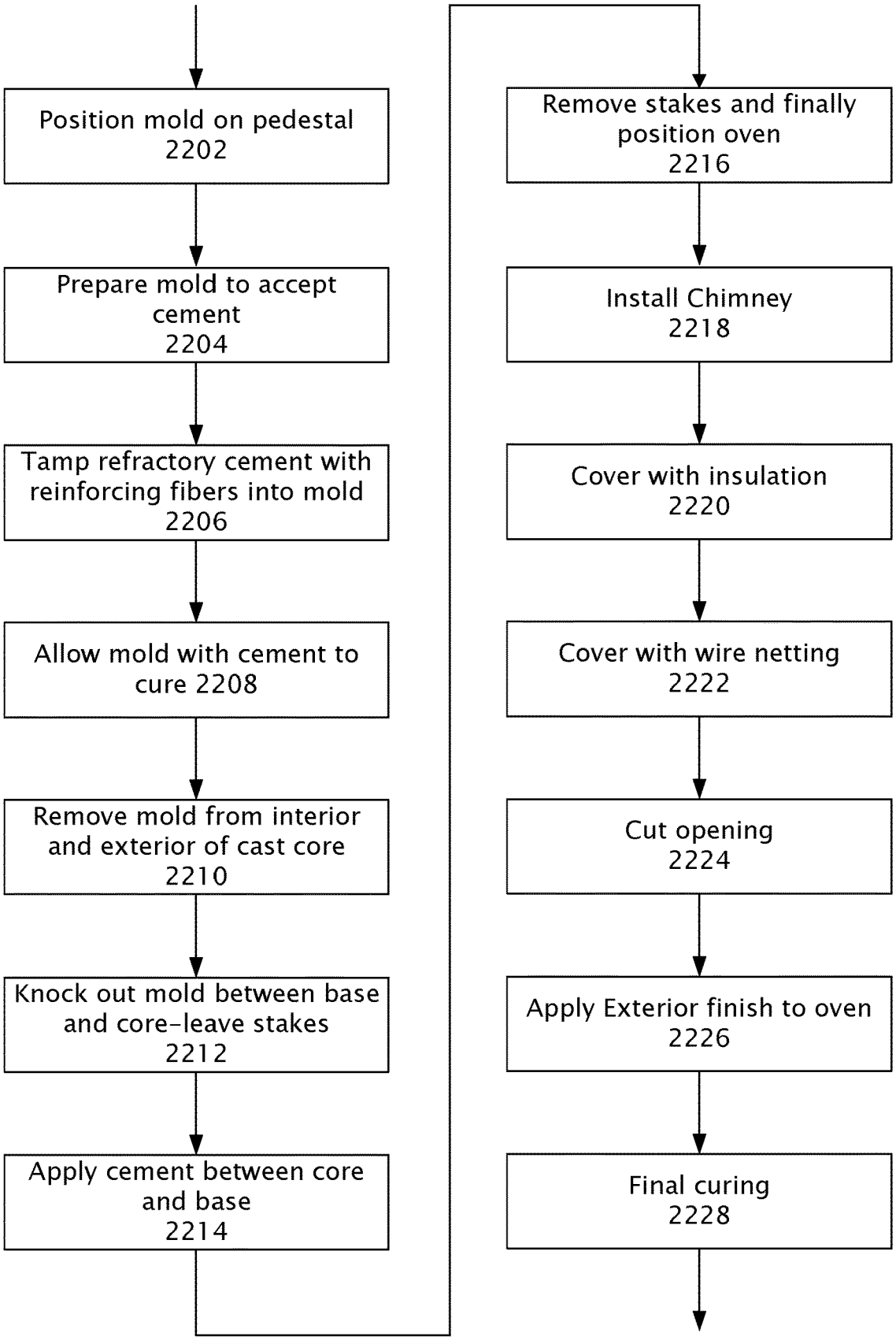
FIG. 22 is a flow chart showing the process of oven construction.

FIG. 22 is a flow chart showing the process of oven construction. The process is a summary of that previously illustrated in FIGS. 6-21. At block 2202 the lightweight mold is positioned on its platform or base. At block 2204 the mold is prepared to accept cement-typically by wetting. At block 2206 refractory cement that has been previously mixed with reinforcing steel fibers is disposed and tamped into the mold. At block 2208 the cement is allowed to cure. At block 2210 the mold is removed from the oven except for a portion acting as a spacer between the cast core and the pedestal. At block 2212 the remaining mold is knocked out with stakes or other rigid material such that only a few points of contact remain between the core and the pedestal. At block 2214 sealant is applied between the core and base, to seal against drafts. At block 2216 the stakes are removed and the core is finally seated and leveled with the pedestal. At block 2218 the chimney is installed. At block 2220 the core is wrapped with insulation. At block 2222 the insulation is covered with wire netting. At block 2224 the insulation and wire netting covering the oven opening is removed. At block 2226 final finishing of stucco brick and the like is applied. At block 2228 final curing is allowed, until the oven is ready to be fired and used for cooking.

Figure 23:
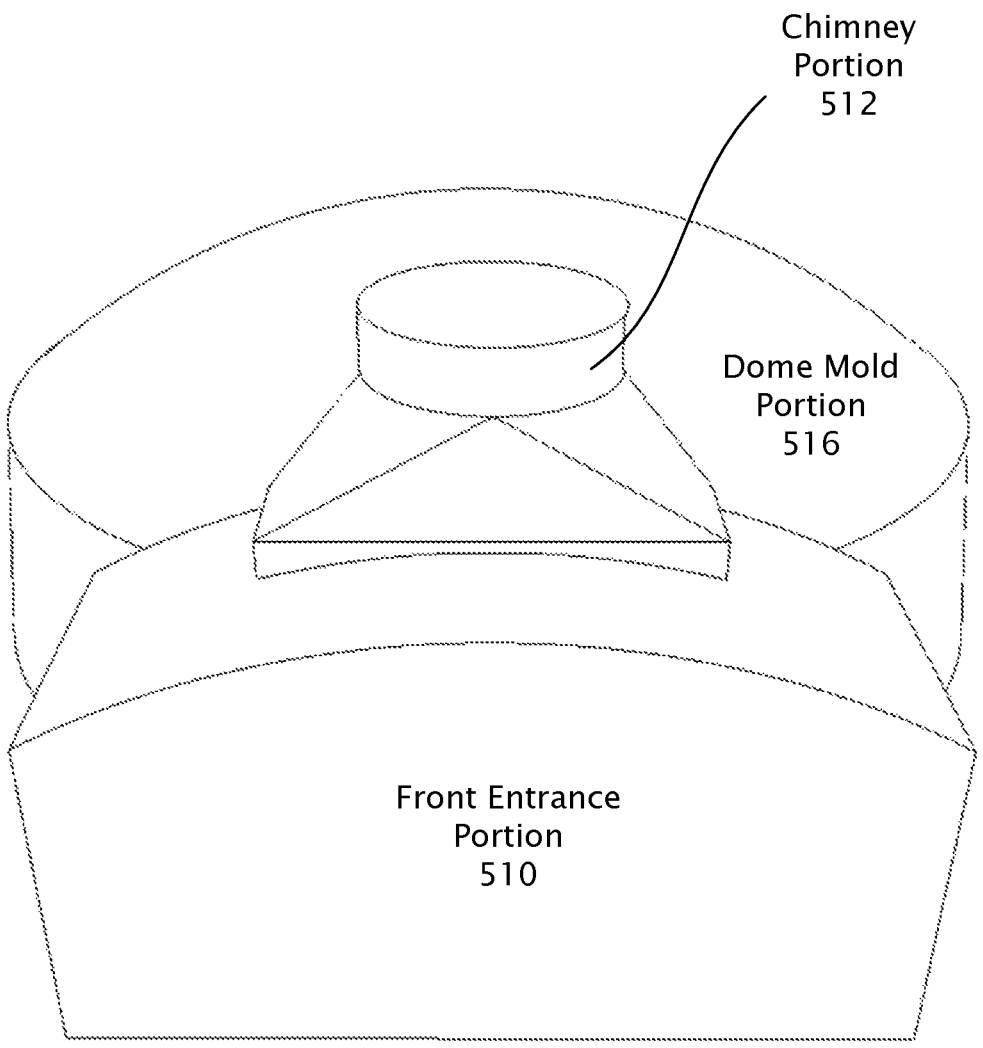
FIG. 23 shows an exemplary oven shape.

FIG. 23 shows an exemplary oven shape 504. A variety of oven shapes may be produced. The core shape or interior mold piece shown is but an example of many possible shapes. A front entrance portion 510 is generally rectangular, with a curved or arched top surface. The front surface is typically coupled to the exterior mold (not shown), and the bottom surface to the bottom spacer sheet (not shown).

At the top curved surface a mold for the chimney may be constructed 512. Coupled to the rear surface is the dome portion of the mold 516. As can be seen the dome portion typically forms a circle and includes vertical sides and a domed top. The components of the interior mold piece are advantageously configured so that when masonry material is poured over them when it is mounted in the exterior mold piece, and the masonry hardened the sacrificial interior and exterior mold piece can be easily removed and discarded.

Figure 24:
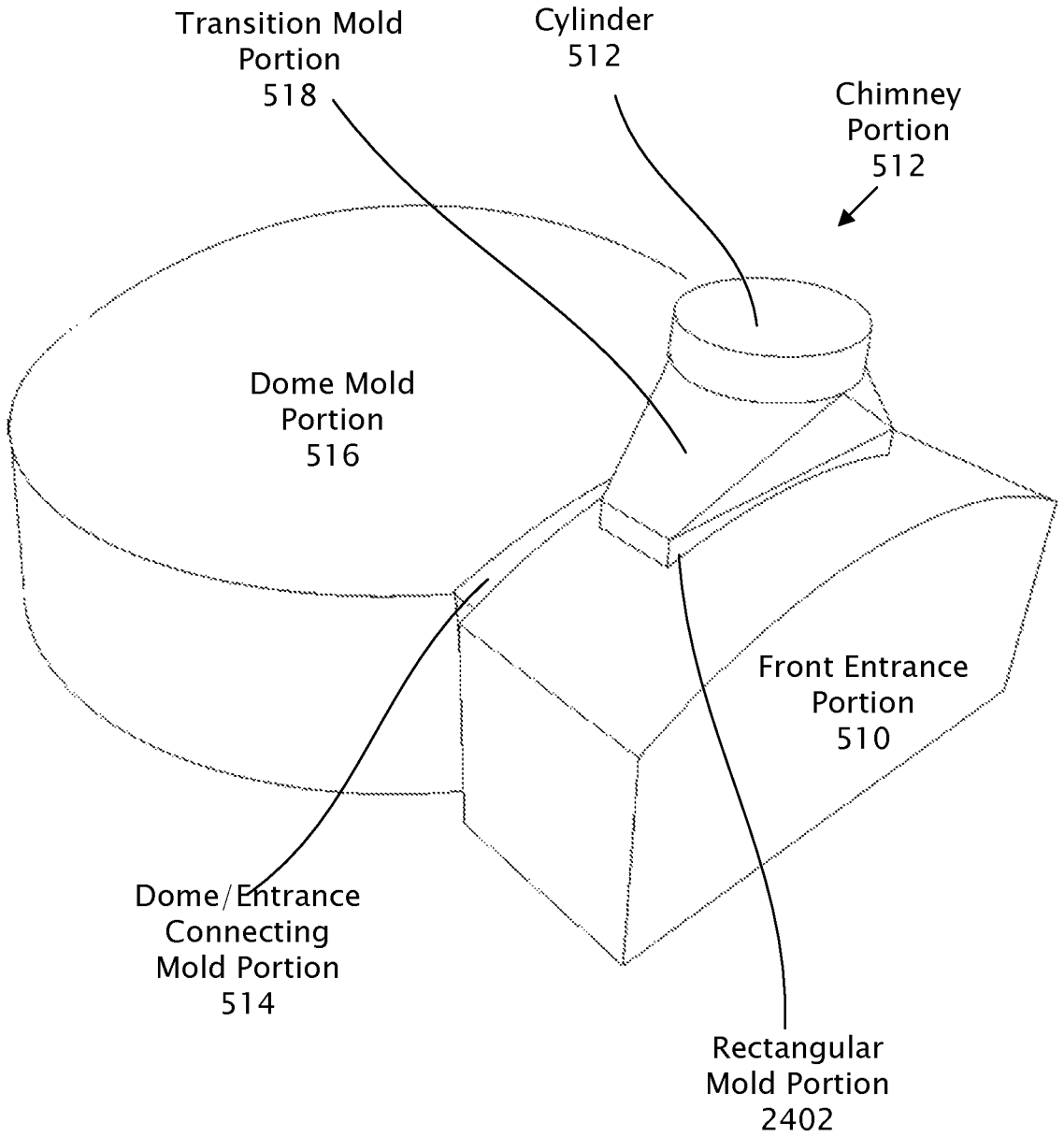
FIG. 24 shows a partial side view of the exemplary oven shape.

FIG. 24 shows a partial side view of the exemplary oven shape of the interior mold piece of FIG. 23. Here the intermediary dome/entrance connecting mold portion 514 can be seen. This piece provides a transition from the generally rectangular opening piece 510 to the domed portion 516. Also further details of the chimney portion 512 are shown, in particular the transition portion 518 that goes from a rectangular shape 2402 to the circular shape 2401 of the chimney.

Figure 25:
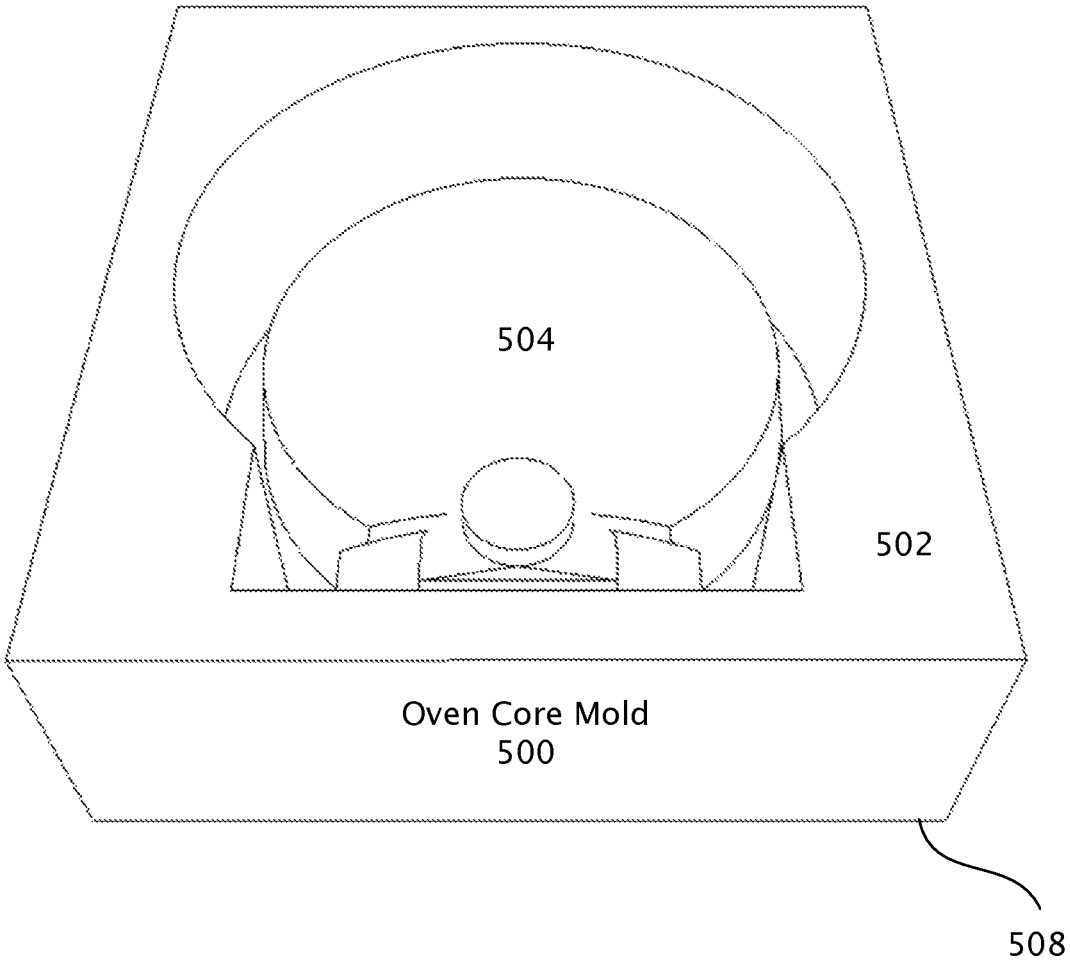
FIG. 25 shows the exemplary oven shape disposed in the oven mold.

FIG. 25 shows the exemplary oven shape of FIGS. 23-24 disposed in the oven mold. A foam oven mold 500 may easily be produced in a number of oven shapes. The sides 502 and bottom 508 may be a common design into which a number of oven shapes may be disposed by gluing or the like to the bottom sheet 508.

Those skilled in the art will realize that the process sequences described above may be equivalently performed in any order to achieve a desired result. Also, sub-processes may typically be omitted as desired without taking away from the overall functionality of the processes described above.

A masonry pizza oven form set comprising;

a bottom spacer sheet;

an exterior mold having an interior void in a shape that defines a pizza oven exterior surface; and an interior oven core form coupled to the bottom spacer sheet so that the oven core form is fixedly positioned in the cavity and defines the interior shape of the oven core, the interior oven core including:

a dome mold portion having a base coupled to the bottom spacer sheet;

a front entrance mold portion of generally rectangular shape coupled to the bottom spacer sheet, and a side wall of the mold exterior;

a dome entrance mold portion connecting portion disposed between the dome portion and the front entrance portion;

a chimney transition mold portion having a generally rectangular base coupled to an arched portion of the front entrance portion, and having a cylindrical top portion; and a chimney mold portion coupled to the cylindrical top portion and extending flush with a top surface of the exterior mold.

The masonry pizza oven form of claim 1 in which the bottom spacer sheet, and interior oven core form are made of foam.

The masonry pizza oven form of claim 2, in which the foam is closed cell foam.

The masonry pizza oven form of claim 2, in which the foam is open cell foam.

The masonry pizza oven form of claim 1 in which the interior oven core foam is a formed from a unitary piece if foam.

The masonry pizza oven form of claim 1 in which the a dome mold portion, front entrance mold portion, dome entrance mold portion, chimney transition mold portion, and chimney mold portion are separate pieces adhesively coupled to form the interior oven core form.

A mold for casting a masonry pizza oven core comprising:

a bottom sheet;

an exterior mold having a rectangular outer surface, and a key shaped interior surface formed by a right cylinder intersecting with a right prism; and an interior mold having a domed shape portion centered in a cylindrical area defined by the interior surface of the exterior mold;

whereby the bottom sheet extends over, and attaches to, a bottom surface of the exterior mold, and is also attached to the interior mold to fixidely position the interior mold relative to the outer mold when filled with a masonry material.

8. The mold for casting a masonry pizza oven core of claim 7, in which the interior mold includes a front entrance portion coupled to a side of the exterior mold.

9. A mold comprising:

exterior mold means for casting an exterior surface of a masonry pizza oven;

an interior mold means for casting an interior surface of a masonry pizza oven; and a bottom sheet means for supporting and positioning the exterior mold means relative to the interior mold means.

The invention claimed is:

1. A masonry pizza oven form set comprising;

a bottom spacer sheet;

an exterior mold having an interior void in a shape that defines a pizza oven exterior surface; and an interior oven core form coupled to the bottom spacer sheet so that the oven core form is fixedly positioned in the cavity and defines the interior shape of the oven core, the interior oven core including:

a dome mold portion having a base coupled to the bottom spacer sheet;

a front entrance mold portion of generally rectangular shape coupled to the bottom spacer sheet, and a side wall of the mold exterior;

a dome entrance mold portion connecting portion disposed between the dome portion and the front entrance portion;

a chimney transition mold portion having a generally rectangular base coupled to an arched portion of the front entrance portion, and having a cylindrical top portion; and a chimney mold portion coupled to the cylindrical top portion and extending flush with a top surface of the exterior mold.

2. The masonry pizza oven form of claim 1 in which the bottom spacer sheet, and interior oven core form are made of foam.

3. The masonry pizza oven form of claim 2, in which the foam is closed cell foam.

4. The masonry pizza oven form of claim 2, in which the foam is open cell foam.

5. The masonry pizza oven form of claim 1 in which the interior oven core foam is a formed from a unitary piece if foam.

6. The masonry pizza oven form of claim 1 in which the a dome mold portion, front entrance mold portion, dome entrance mold portion, chimney transition mold portion, and chimney mold portion are separate pieces adhesively coupled to form the interior oven core form.

* * * * *